US009498004B2

(12) United States Patent
Farrell

(10) Patent No.: US 9,498,004 B2
(45) Date of Patent: Nov. 22, 2016

(54) APPAREL WITH DRAINAGE SUPPORT

(71) Applicant: Andrea Farrell, Carmel, IN (US)

(72) Inventor: Andrea Farrell, Carmel, IN (US)

( * ) Notice: Subject to any disclaimer, the term of this patent is extended or adjusted under 35 U.S.C. 154(b) by 204 days.

(21) Appl. No.: 14/031,677

(22) Filed: Sep. 19, 2013

(65) Prior Publication Data

US 2015/0080860 A1 Mar. 19, 2015

(51) Int. Cl.

| | |
|---|---|
| ***A41C 3/02*** | (2006.01) |
| ***A61M 27/00*** | (2006.01) |
| ***A41C 3/00*** | (2006.01) |
| *A41C 3/06* | (2006.01) |

(52) U.S. Cl.

CPC ..... *A41C 3/0064* (2013.01); *A41C 3/06* (2013.01)

(58) Field of Classification Search

CPC ..... A41C 3/0064; A41C 3/12

See application file for complete search history.

(56) References Cited

U.S. PATENT DOCUMENTS

| | | | | |
|---|---|---|---|---|
| 4,816,005 | A * | 3/1989 | Braaten | 450/58 |
| 5,968,597 | A * | 10/1999 | Vogt et al. | 427/377 |
| 6,346,210 | B1 * | 2/2002 | Swartz et al. | 264/486 |
| 2001/0019933 | A1 * | 9/2001 | Wagner | 450/37 |
| 2002/0121273 | A1 * | 9/2002 | Nyilas | 128/99.1 |
| 2004/0002288 | A1 * | 1/2004 | Bell | A41C 3/0064 450/75 |
| 2006/0009124 | A1 * | 1/2006 | Falla | A41C 3/02 450/58 |
| 2006/0228988 | A1 * | 10/2006 | Weyenberg | A41C 3/02 450/58 |
| 2009/0053975 | A1 * | 2/2009 | Nuzzo | A41C 3/0028 450/70 |
| 2009/0081924 | A1 * | 3/2009 | Puyaubreau | A41C 3/14 450/39 |
| 2009/0233522 | A1 * | 9/2009 | Schlatmann | A41C 3/0057 450/39 |
| 2011/0237146 | A1 * | 9/2011 | Zumloh-Nebe | 442/308 |
| 2012/0045967 | A1 * | 2/2012 | Punsal | 450/82 |
| 2012/0244782 | A1 * | 9/2012 | Pundyk | A41C 3/0021 450/70 |
| 2013/0171911 | A1 * | 7/2013 | Swendseid et al. | 450/85 |
| 2013/0288569 | A1 * | 10/2013 | Gentry et al. | 450/86 |
| 2014/0295734 | A1 * | 10/2014 | Shashy | 450/58 |

* cited by examiner

*Primary Examiner* — Susan Su

(74) *Attorney, Agent, or Firm* — GrayRobinson, P.A.; Michael J. Colitz, III

(57) ABSTRACT

Disclosed is a support garment. The support garment is particularly configured to permit a post-surgical drainage tube to pass through the support garment unobstructed, thereby permitting the drainage of blood and other bodily fluids from the surgical site. The support garment employs a series of elastic panels joined in a way to provide comfort and utility, and includes a fastener in the front for enabling a wearer with decreased mobility to more easily apply and remove the support garment.

11 Claims, 4 Drawing Sheets

APPAREL WITH DRAINAGE SUPPORT

TECHNICAL FIELD

This disclosure relates to a support garment. More specifically, this disclosure relates to a support garment with an opening that allows a post-surgical drainage tube to pass from a patient to a collection reservoir without obstructing the drainage flow.

BACKGROUND OF THE INVENTION

Support garments are known in the art. Typically, support garments are in the form of a bra and include two molded cups in the front, back straps that extend from the cups to the back of the wearer, and a pair of shoulder straps. Bras often further include a rigid underwire at the lower base of the cups and a hook and eye type fastener at the opposing ends of the back straps. Athletic bras, on the other hand, often eliminate the rigid underwires, back straps, and fasteners found in a traditional bra, and instead are made of an elastic material that is slipped over the head to be worn.

Common surgical procedures performed on a woman's breasts, such as a mastectomy, lumpectomy, or quandrantectomy, often conclude with the placement of a post-surgical drainage tube within the woman (typically below the underarm) to permit the drainage of blood and other fluids from the surgical site to aid in recovery and healing. Further, the surgical procedures above often result in a substantial amount of post-operative pain and discomfort, as well as decreased arm and shoulder mobility.

Thus, a need exists for a support garment capable of accommodating a post-surgical drainage tube that also provides increased comfort and can be worn without having to raise the arms to be slipped over the head.

SUMMARY OF THE INVENTION

One possible advantage of the present disclosure is achieved by providing a support garment sufficient for accommodating a post-surgical drainage tube.

A further possible advantage of the present disclosure is achieved by providing a support garment with an aperture sufficient for accommodating a post-surgical drainage tube.

Still yet another advantage of the present disclosure is achieved by providing a support garment that permits the unobstructed flow of fluid through a post-surgical drainage tube.

The present disclosure realizes still yet another advantage by providing a support garment with a fastener in the front for simplified application and removal.

Yet another advantage of the present disclosure is achieved by providing a support garment with a seamless inner liner for increased comfort.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

| PARTS LIST |
|---|
| 10 support garment |
| 12 rib band |
| 14 first end of rib band |
| 16 second end of rib band |
| 18 first front panel |
| 20 second front panel |
| 22 lower seam |
| 24 back panel |
| 26 upper seam |
| 28 shoulder strap |
| 30 side panel |
| 32 first seam |
| 34 second seam |
| 36 post-surgical drainage tube |
| 38 aperture |
| 40 inner seamless layer |
| 42 fastener |
| 44 inner protective flap |

DETAILED DESCRIPTION OF THE DRAWINGS

The present invention relates to a post-surgical support garment that is particularly configured to allow a post-surgical drainage tube to pass through the support garment unobstructed, thereby permitting the release of blood and lymphatic fluid from under the skin following surgery, thus encouraging healing and recovery. The garment is particularly configured to be worn by a woman following breast surgery. In one embodiment of the invention the support garment is a bra. It is also envisioned that the garment may be worn by men and configured to accommodate the male physical form. In one non-limiting embodiment of the present invention, the garment employs a series of interconnected panels of elastic material joined together in such a way that an aperture is formed in the garment sufficient for the passage of a post-surgical drainage tube. In one particular embodiment, the support garment has shoulder straps. In another embodiment, the support garment is strapless. In yet another embodiment, the elastic material is a cellulosic material including cellulose and seaweed, such as SeaCell®, a therapeutic material that has a level of compression and composition that aids in comfort and healing. The various components of the present invention, and the manner in which they interrelate, are described in greater detail hereafter.

Figure 1:
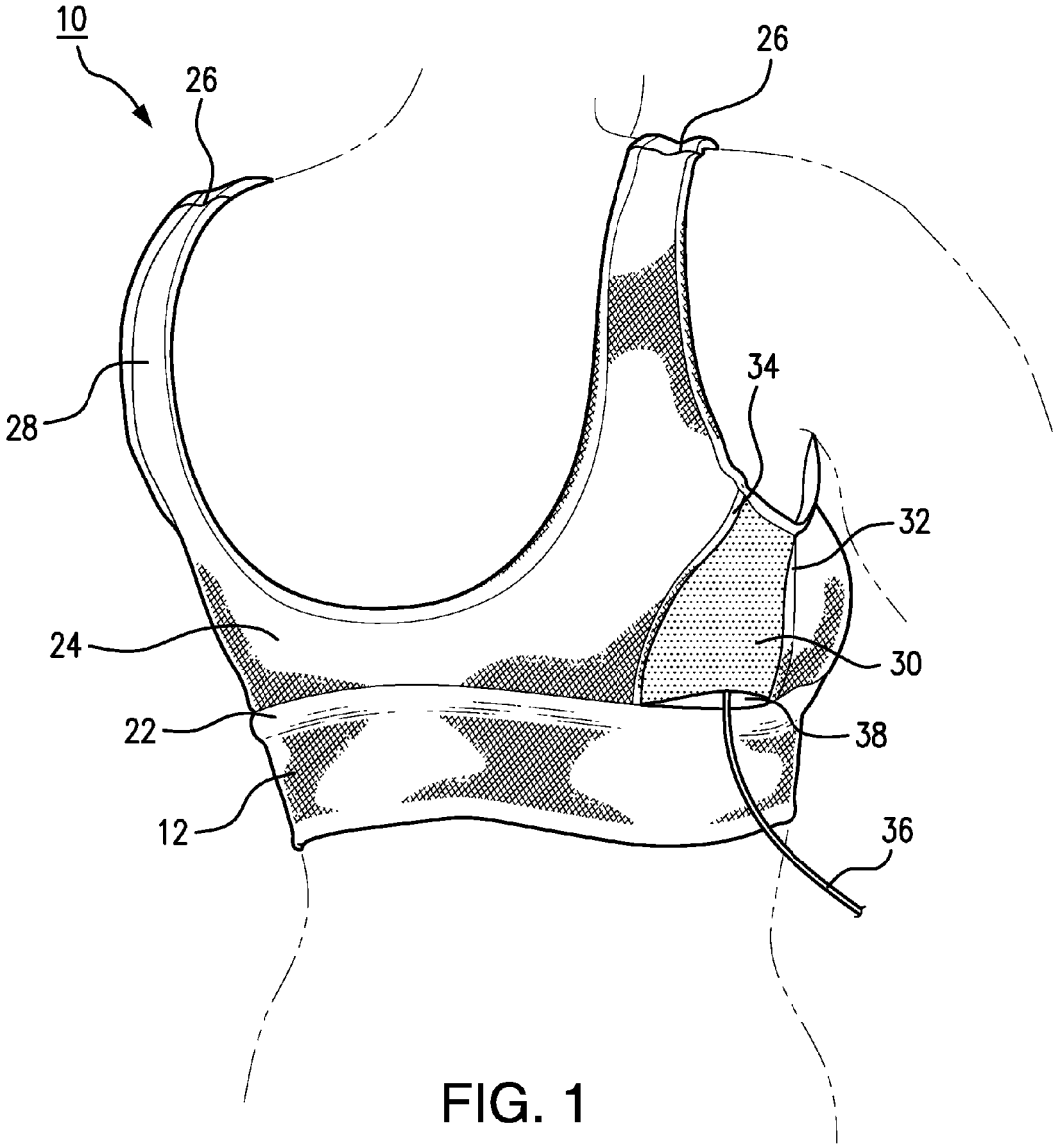
FIG. 1 is a rear perspective view of one embodiment of the support garment of the present disclosure.
Figure 2:
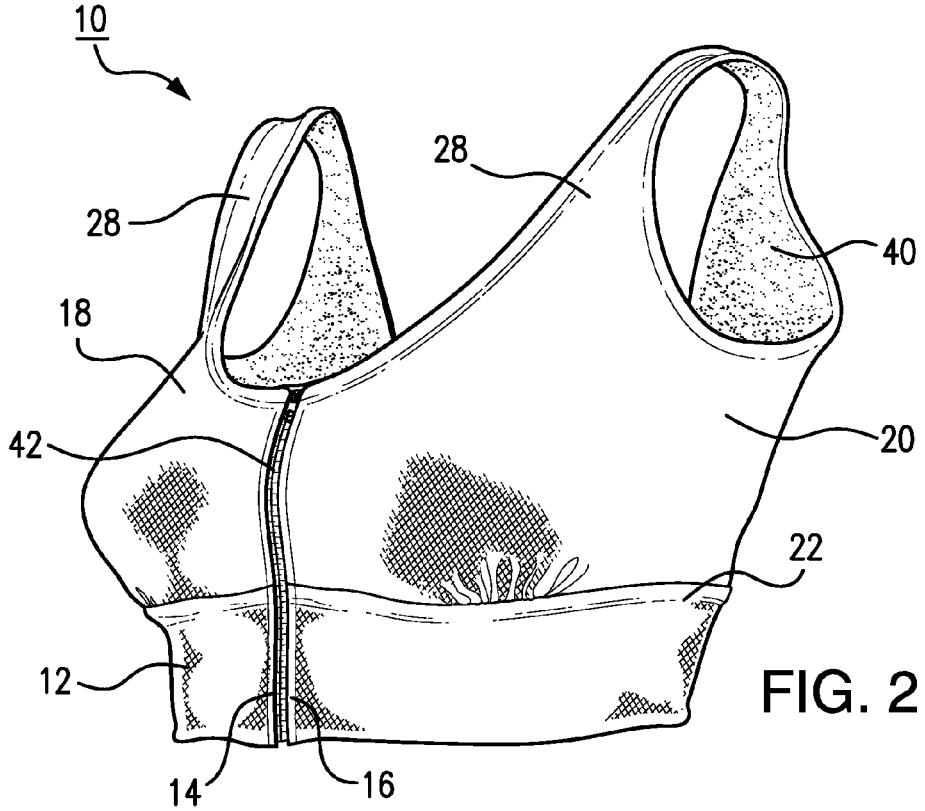
FIG. 2 is a front perspective view of one embodiment of the support garment of the present disclosure.
Figure 3:
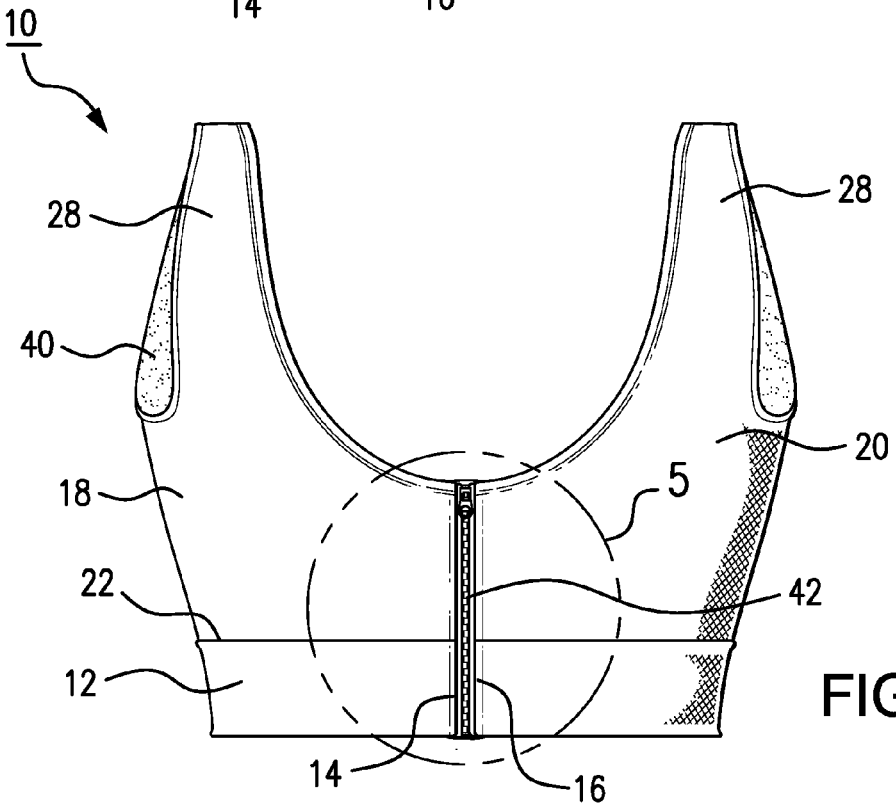
FIG. 3 is a front plan view of one embodiment of the support garment of the present disclosure.

As noted in FIGS. 1-3, the support garment includes a rib band 12 having a first end 14 and a second end 16, the rib band 12 comprising a first elastic material having a first elastic modulus, the first elastic material comprising a cellulosic fiber including cellulose and seaweed. The rib band 12 encircles the torso of the wearer, and may be positioned lower on the torso than a typical support garment for increased comfort following a surgical procedure. In one particular, but non-limiting example, the support garment includes a first front panel 18 and a second front panel 20, the front panels 18, 20 joined to the rib band 12 by a lower seam 22, the front panels 18, 20 comprising a second elastic material having a second elastic modulus, the second elastic material comprising a cellulosic fiber including cellulose and seaweed, wherein the second elastic modulus is less than the first elastic modulus.

Figure 4:
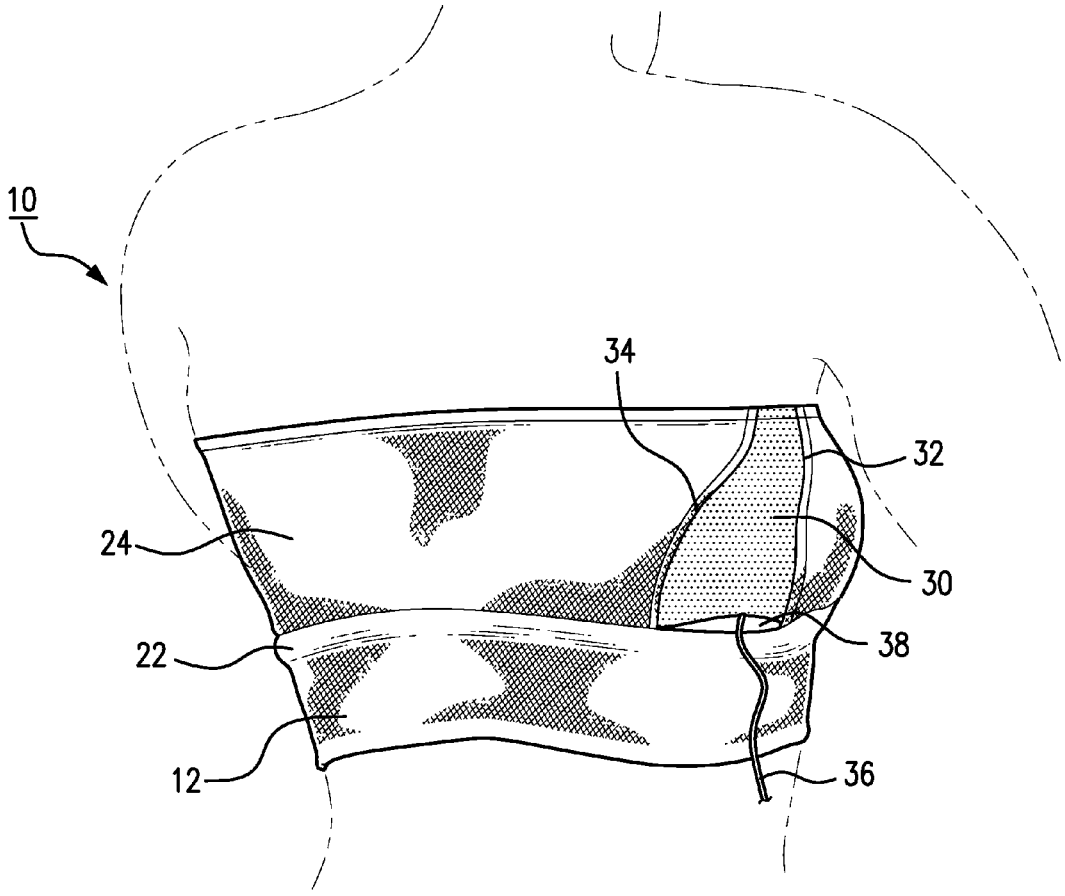
FIG. 4 is a rear perspective view of another embodiment of the support garment of the present disclosure.

With continued reference to FIG. 1, and with reference to FIG. 4, an embodiment of the invention may include a back panel 24 proximally joined to the rib band 12 by the lower seam 22 and distally joined to the front panels 18, 20 by two upper seams 26, wherein portions of the front panels 18, 20 and the back panel 24 form two shoulder straps 28, the back panel 24 comprising the second elastic material. It is further contemplated that a single panel may embody both the front and the back of the garment, the single panel including a pair of seamless shoulder straps. It is also envisioned that the support garment may include a pair of side panels 30, each side panel 30 joined to the front panels 18, 20 by a first seam 32 and to the back panel 24 by a second seam 34, each side panel 30 comprising a third elastic material having a third elastic modulus, the third elastic material comprising a cellulosic fiber including cellulose and seaweed, wherein the third elastic modulus is less than the second elastic modulus, each side panel being narrower at the top than at the bottom. Another embodiment of the invention may include side panels with uniform top and bottom dimensions.

In accordance with the present invention, further envisioned is a post-surgical drainage tube 36 extending through at least one of a pair of apertures 38, each aperture 38 formed between each side panel 30 and the rib band 12 and sufficient for permitting the post-surgical drainage tube 36 to pass through the support garment 10 unobstructed, thereby permitting the flow of blood and other fluids through the tube. In another embodiment of the invention, a collection reservoir is connected to the distal end of the tube for receiving the blood and other fluids from the post-surgical drainage tube that has been inserted into a patient.

With reference to FIG. 2, an embodiment of the present invention includes an inner seamless layer 40, the inner seamless 40 layer joined to the front panels 18, 20, the back panel 24, and the rib band 12, the inner seamless layer 40 comprising a fourth elastic material, the fourth elastic material comprising a cellulosic fiber including cellulose and seaweed. The inner seamless layer increases the comfort of the support garment by reducing the number of abrasive points between the support garment and the wearer.

Figure 5A:
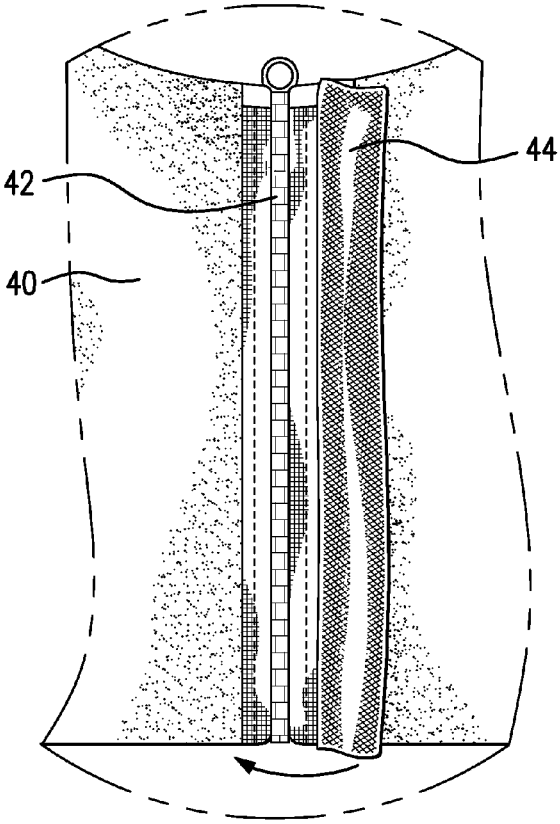
FIG. 5A is a view from the inside of the support garment of the present disclosure depicting the inner protective flap in a first orientation.
Figure 5B:
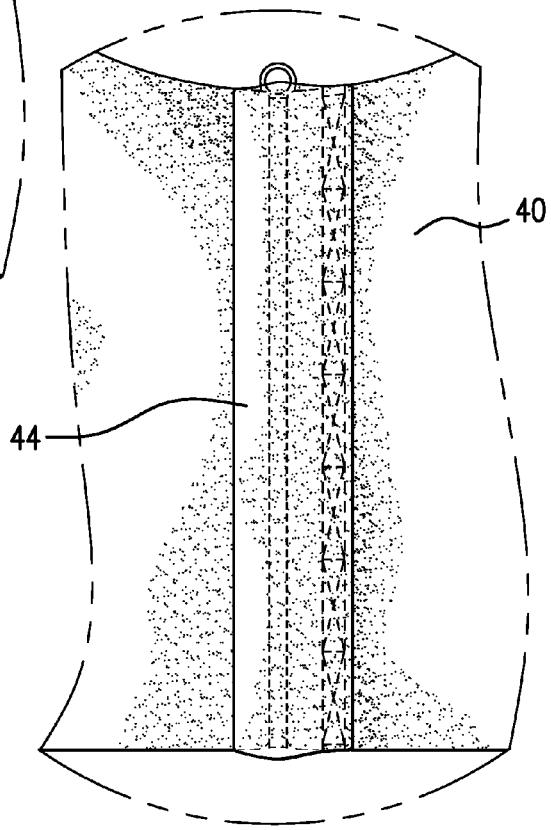
FIG. 5B is a view from the inside of the support garment of the present disclosure depicting the inner protective flap in a second orientation.

With reference now to FIGS. 5A and 5B, an embodiment of the invention includes a fastener 42 positioned at the front of the support garment 10, the fastener 42 connected to the first and second front panels 18, 20 and sufficient for joining the first and second front panels 18, 20, the fastener 42 further connected to the first and second ends 14, 16 of the rib band 12 and sufficient for joining the first and second ends 14, 16. In one non-limiting embodiment of the invention, the fastener comprises a zipper. Further envisioned is an inner protective flap 44 joined to the inner seamless layer 40, the inner protective flap 44 comprising a fifth elastic material, the fifth elastic material comprising a cellulosic fiber including cellulose and seaweed, the inner protective flap 44 sufficient for preventing the fastener 42 from contacting the wearer's skin.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A support garment (10) for a woman, the support garment (10) comprising:

a rib band (12) having a first end (14) and a second end (16), the rib band (12) comprising a first elastic material having a first elastic modulus, the first elastic material comprising a cellulosic fiber including cellulose and seaweed;

a first front panel (18) and a second front panel (20), the front panels (18, 20) joined to the rib band (12) by a lower seam (22), the front panels (18, 20) comprising a second elastic material having a second elastic modulus, the second elastic material comprising a cellulosic fiber including cellulose and seaweed, wherein the second elastic modulus is less than the first elastic modulus;

a back panel (24) proximally joined to the rib band (12) by the lower seam (22) and distally joined to the front panels (18, 20) by two upper seams (26), wherein portions of the front panels (18, 20) and the back panel (24) form two shoulder straps (28), the back panel (24) comprising the second elastic material;

a pair of side panels (30), each side panel (30) joined to the front panels (18, 20) by a first seam (32) and to the back panel (24) by a second seam (34), each side panel (30) comprising a third elastic material having a third elastic modulus, the third elastic material comprising a cellulosic fiber including cellulose and seaweed, wherein the third elastic modulus is less than the second elastic modulus, each side panel being narrower at the top than at the bottom;

a post-surgical drainage tube (36) extending through at least one of a pair of apertures (38), each aperture (38) formed between each side panel (30) and the rib band (12) and sufficient for permitting the post-surgical drainage tube (36) to pass through the support garment (10) unobstructed;

an inner seamless layer (40), the inner seamless (40) layer joined to the front panels (18, 20), the back panel (24), and the rib band (12), the inner seamless layer (40) comprising a fourth elastic material, the fourth elastic material comprising a cellulosic fiber including cellulose and seaweed;

a fastener (42) positioned at the front of the support garment (10), the fastener (42) connected to the first and second front panels (18, 20) and sufficient for joining the first and second front panels (18, 20), the fastener (42) further connected to the first and second ends (14, 16) of the rib band (12) and sufficient for joining the first and second ends (14, 16);

an inner protective flap (44) joined to the inner seamless layer (40), the inner protective flap (44) comprising a fifth elastic material, the fifth elastic material comprising a cellulosic fiber including cellulose and seaweed, the inner protective flap (44) sufficient for preventing the fastener (42) from contacting the woman's skin.

2. A support garment comprising:

a rib band (12) having a first end (14) and a second end (16), the rib band (12) comprising a first elastic material having a first elastic modulus;

a first front panel (18) and a second front panel (20), the front panels (18, 20) joined to the rib band (12) by a lower seam (22), the front panels (18, 20) comprising a second elastic material having a second elastic modulus, wherein the second elastic modulus is less than the first elastic modulus;

a back panel (24) joined to the rib band (12) by the lower seam (22);

a pair of side panels (30), each side panel (30) joined to the front panels (18, 20) by a first seam (32) and to the back panel (24) by a second seam (34) sufficient for forming at least one aperture (38) for permitting a post-surgical drainage tube (36) to pass through the support garment (10) unobstructed, each side panel (30) comprising a third elastic material having a third elastic modulus, wherein the third elastic modulus is less than the second elastic modulus, each side panel being narrower at the top than at the bottom.

3. The support garment (10) described in claim 2, wherein portions of the front panels (18, 20) and the back panel (24) are joined to form two shoulder straps (28).

4. The support garment (10) as described in claim 2, further comprising an inner seamless layer (40) joined to the front panels (18, 20), the back panel (24), and the rib band (12).

5. The support garment (10) described in claim 2, further comprising a fastener (42) positioned at the front of the support garment (10), the fastener (42) connected to the first and second panels (18, 20) and sufficient for joining the first and second front panels (18, 20), the fastener (42) further connected to the first and second ends (14, 16) of the rib band (12) and sufficient for joining the first and second ends (14, 16).

6. The support garment (10) described in claim 5, wherein the fastener (42) is a zipper.

7. The support garment (10) described in claim 5, further comprising an inner protective flap (44) sufficient for preventing the fastener (42) from contacting the wearer's skin.

8. The support garment (10) as described in claim 7, the rib band (12), the front panels (18, 20), the back panel (24), the side panels (30), the inner seamless layer (40), and the inner protective flap (44) comprising an elastic material.

9. The support garment (10) described in claim 8, the elastic material comprising a cellulosic material including cellulose and seaweed.

10. The support garment (10) as described in claim 7, the rib band (12), the front panels (18, 20), the back panel (24), the side panels (30), the inner seamless layer (40), and the inner protective flap (44) comprising a plurality of elastic materials having a plurality of elastic moduli.

11. The support garment (10) as described in claim 10, the plurality of elastic materials comprising a cellulosic material including cellulose and seaweed.

* * * * *